US005387313A

United States Patent [19]

Thoms

[11] Patent Number: 5,387,313

[45] Date of Patent: Feb. 7, 1995

[54] ETCHANT CONTROL SYSTEM

[75] Inventor: Roland Thoms, Cortland, N.Y.

[73] Assignee: BMC Industries, Inc., Minneapolis, Minn.

[21] Appl. No.: 95,400

[22] Filed: Jul. 23, 1993

Related U.S. Application Data

[63] Continuation-in-part of Ser. No. 973,679, Nov. 9, 1992.

[51] Int. Cl.[6] ..... B05B 3/00; C23F 1/00

[52] U.S. Cl. ..... 156/626; 156/640; 156/664; 156/345; 134/15; 134/64 R; 134/122 R; 134/129; 134/172; 134/199

[58] Field of Search ..... 156/345, 640, 666, 665, 156/664, 626; 134/15, 64 R, 122 R, 129, 172, 199

[56] References Cited

U.S. PATENT DOCUMENTS

| | | | |
|---|---|---|---|
| 3,401,068 | 1/1968 | Benton | 156/3 |
| 3,419,446 | 12/1968 | Benton | 156/3 |
| 3,645,811 | 2/1972 | Davis et al. | 156/5 |
| 3,669,771 | 6/1972 | Lerner | 156/8 |
| 3,788,912 | 1/1974 | Frantzen et al. | 156/6 |
| 3,808,067 | 4/1974 | Brown | 156/640 X |
| 4,124,437 | 11/1978 | Bono et al. | 156/640 |
| 4,126,510 | 11/1978 | Moscony et al. | 156/640 X |
| 4,397,708 | 8/1984 | Frantzen | 156/345 |
| 4,741,798 | 5/1988 | Haas | 156/626 |
| 4,985,111 | 1/1991 | Ketelhohn | 156/640 |
| 5,002,627 | 3/1991 | Scheithauer et al. | 156/640 X |
| 5,200,023 | 4/1993 | Gifford et al. | 156/626 |
| 5,228,949 | 7/1993 | Ketelhohn et al. | 156/640 |

*Primary Examiner*—Thi Dang

*Attorney, Agent, or Firm*—Kinney & Lane

[57] ABSTRACT

An etching system for etching openings in a metal web including multiple etching station for etching a metal web from opposite sides, with each of the etching stations including a set of first bank of oscillatable nozzles located in a first chamber in the etching station, with the first bank of oscillatable nozzles having predetermined spacings from one another and operable for directing etchant at a first side of a metal web and a second bank of oscillatable nozzles located in a second chamber in the etching station, with the second bank of oscillatable nozzles having a predetermined spacing substantially identical to the first bank of oscillatable nozzles, with the second set of oscillatable nozzles laterally offset from the first set of nozzles, so they do not spray on directly opposite regions located on the metal web, with the banks of the nozzles in adjacent etching stations offset from each other with the oscillation axis of the nozzles at an angle off normal, so that etchant is sprayed in elliptical patterns on the metal web to more uniformly distribute etchant across the metal web, including a system to oscillate the nozzles in different waveforms in response to measurements of openings in the metal web to compensate for changing etching conditions or changes in the thickness of the metal web without having to change the etchant flow rate to the metal web or the etchant pressure in the nozzles. Thus, the system includes hydraulic cylinders to oscillate the nozzles in accordance with a waveform different from the original waveform in response to a measurement of the metal web and allows the system to compensate, if necessary, for changing etching conditions or changes in the thickness of the metal web.

15 Claims, 9 Drawing Sheets

$C_W$
100
102
104
101
105
103
61
52
$Z_X$
21a
θ
62
42
41
21h
63
55
54c
54
$h_X$
21h
54b
21n
9a
9
54a
9b
57
21n'
53a
21h'
53
56
53b
65
$X_{11}$
$X_9$
$X_7$
$X_5$
$X_3$
$X_1$
64
53c
$X_{10}$
$X_8$
$X_6$
$X_4$
$X_2$
21b
$Z_{X'}$
θ
60
$C_W$

ETCHANT CONTROL SYSTEM

CROSS REFERENCE TO RELATED APPLICATIONS

This application is a continuation-in part of my copending U.S. patent application Ser. No. 07/973,679 titled Etchant Distribution Apparatus filed Nov. 9, 1992.

FIELD OF THE INVENTION

This invention relates generally to etching metal webs and, more particularly, to means and method for more quickly and automatically making on-the-go adjustments to the etchant rate on the metal web without having to shutdown the system to adjust and fine-tune the etching equipment and without having to change the fluid pressure or flow rate through the etching nozzles.

BACKGROUND OF THE INVENTION

In the etching of metal webs, and, in particular, in the etching of metal webs from opposite sides, it is difficult to uniformly control the distribution of etchant throughout the metal web. If holes are being etched in the metal web, the size and shape of the holes may vary substantially as a result of non-uniform etchant distribution.

One method used to more uniformly distribute the etchant is to place a first set of oscillatable etchant spray nozzles above the metal web and a second set of oscillatable etchant spray nozzles below the metal web, with both sets of oscillatable nozzles spraying etchant directly onto the metal web. The nozzles are then oscillated in accordance with a sinusoidal waveform generated by a rotating wheel. The result is an etching process which has better dimensional controls, since the oscillating nozzles more uniformly distribute the etchant on the metal web than non-oscillating nozzles.

However, even with oscillating the nozzles, the spray patterns may not be uniform, sometimes resulting in uneven etching. The problem with uneven etching is that once breakthrough occurs in a metal web, that is, a hole has been formed in the web, etching proceeds at a much more rapid rate, since fresh etchant is continuously applied to the sides of the hole. The result is that a first pre-breakthrough etching rate exists, and a second post-breakthrough etching rate exists after the opening or hole is formed. Consequently, if enlargement of all the holes in the metal are not begun simultaneously, the holes can become irregular and misshapen as a result of the different etching rates before and after breakthrough.

One of the goals of the oscillatable nozzles is to more uniformly distribute etchant to have the breakthrough occur at substantially the same time throughout the metal web. If the rate of etching proceeds at a constant rate throughout the metal web, one can accurately control the final dimensions of openings formed in the metal web. However, changing etching conditions or varying thickness of the metal web may require changing the etching rate by changing the delivery of the etchant to the metal web.

To change the spray pattern of the oscillating nozzles or to change the etching rates usually requires system shutdown so the operators can make manual adjustments to the nozzle stroke as well as other adjustments to the system. In some cases, the pressure to the nozzles or the flow rate to the nozzles is changed to control the etchant rate. Typical of such a system is the control system shown in U.S. Pat. No. 3,645,811, which shows a system that changes etchant valve settings in response to measurements of the size of openings in the aperture mask.

In general, the concept of etching equipment in which the size of the holes in the aperture mask is monitored and more or less etchant is applied to the mask is known in the art. Another such system is shown in U.S. Pat. No. 3,756,898 which relates to an etching system for enlarging holes without the aid of an etchant resist.

Typically, in the prior-art systems, more or less etchant is sprayed through the individual nozzle by opening or closing the valves. In addition, the position of the nozzles above the mask can be adjusted to put more or less etchant in one particular area.

In still other types of etching systems, which use a protective etchant resist located over a traveling web material, the pressure of the etchant is typically increased or decreased to increase or decrease the etchant flow to change the etching rate of the material. Typically, etchant spray nozzles,which are located above and below the material, are oscillated at a predetermined frequency. In order to control the size and shape of etched holes in the web material passing between the spray nozzles, one can increase or decrease the etchant rate on the web passing between the nozzles. For example, the amplitude of the nozzle oscillation may be changed or the speed of the oscillation may be changed or the angle of spray from the nozzle may be changed. Depending on the material and other conditions, such adjustments will change the size of the final hole in the web material. These changes in etchant supply are necessary to compensate for changing etching conditions and variations in metal web thickness and shape. This problem is particularly acute when one roll of metal web is fastened to another since each roll of metal web has its own individual characteristics. That is, the thickness of some webs may vary or some webs instead of having a rectangular cross-sectional shape may have a convex shape, a concave shape or a general triangular cross-sectional shape. Consequently, the transition from one roll of web material to another during an inline etching process may cause variations in the size or shape of the etched openings in the web if the etching rate is not adjusted accordingly.

While the adjustments to the nozzle flow rate and etchant distribution can be accomplished to compensate for changes in web shape and size, one of the problems with these adjustments is that in systems where one is etching precision openings, such as those that have a minimum dimension less than the thickness of the metal, it takes time to make the necessary adjustments to the etching system after the measurements have been made. Typically, in an inline etching system, after the mask leaves the etching chamber, requires approximately 20 minutes until the holes in the mask have been measured and the information regarding the size of the holes is available to the operator. However, it may take up to 16 hours or more of manual adjustments to the etching stations and observations of the effect of the adjustments before one can determine that the etching system has been properly adjusted for the web material in the etching system.

In the present process, manual adjustments of oscillation amplitude, frequency and nozzle angle can be virtually eliminated through the use of members to automatically change the waveform of the oscillating nozzle spraying etchant onto the mask without having to alter the pressure or flow rate of the etchant through the nozzles. The result is an on-the-go etchant spray distribution system in which one can quickly compensate for changing etching conditions by changing the waveform of the means for oscillating the nozzles to produce the desired etching correction. Such changes normally would require changing the etchant distribution pattern on the mask by change the nozzle pressures, spacing, or flow rates or the speed of the web in the etching chambers. A further benefit is that unwanted etching changes resulting from coaction between the etchant spray and the metal are virtually eliminated because the pressure and flow rates in the nozzle can remain the same before and after the change in the waveform.

DESCRIPTION OF THE PRIOR ART

U.S. Pat. No. 3,645,811 shows an etching system for controlling the size of apertures by spraying more or less etchant on a mask in response to the measurement of the hole size.

U.S. Pat. No. 3,401,068 shows an etching control system for controlling the etching by controlling the conveyor speed of the material carded through the etching chambers.

U.S. Pat. No. 3,419,446 shows an alternate embodiment of a variable speed drive for controlling the etching rate by controlling the conveyor speed of the material carried through the etching chambers.

U.S. Pat. No. 3,669,771 shows the use of an air source and photocell to measure the hole size in an aperture mask.

U.S. Pat. No. 3,788,912 shows a system for enlarging openings in aperture mash in which the etching rate is controlled by vertically positioning of the nozzles above the mask.

U.S. Pat. No. 3,808,067 shows a method of controlling an etching process wherein the etchant flow rate or the conveyor speed is adjusted according to the difference between measurements taken from the etched article and a standard measure.

U.S. Pat. No. 4,124,437 shows an etching system with upper and lower oscillating nozzles.

U.S. Pat. No. 4,126,510 shows an etching system in which the thickness of the metal strip is monitored and etching is adjusted by changing the pressure or turbulence of the etching system.

U.S. Pat. No. 4,985,111 shows a cylinder for controlling a gate valve to alternately open and close the supply lines to the etching nozzles to delver the fluid sequentially to prevent etchant puddling on the article.

U.S. Pat. No. 5,002,627 shows a spray-etching apparatus for individually controlling etching jets wherein the spray pressure of the jets is altered to change the etching rate.

U.S. Pat. No. 5,200,023 shows a etching system in which an infrared television camera monitors the etching of a substrate in an etching chamber, and feedback control is achieved by adjusting parameters such as gas pressure, flow pattern, magnetic field or coolant flow to the electrode.

BRIEF SUMMARY OF THE INVENTION

An etching system for etching openings in a metal web including an etching station for etching a metal web from opposite sides with the etching system including a first bank of oscillatable nozzles located in a first chamber in the etching station, with the first bank of oscillatable nozzles having predetermined spacings from one another, and operable for directing etchant at a first side of a metal web. The system includes a second bank of oscillatable nozzles located in a second chamber in the etching station, with the second bank of oscillatable nozzles having a predetermined spacing substantially identical to the first bank of oscillatable nozzles with the second set of oscillatable nozzles laterally offset from the first set of nozzles, so as not to spray on directly opposite regions located on the metal web. In addition, the oscillation axis of the nozzles is off normal so that etchant is sprayed in general elliptical patterns on the metal web with the control of the etchant rate accomplished by means such as a waveform generator that changes the waveform of the oscillating nozzle to alter the pattern of etchant sprayed onto a region of the metal web and thereby compensate for on-to-go changes in etching conditions or in the thickness of the metal web without having to change the etchant pressure or the etchant flow rate to the nozzles.

DESCRIPTION OF THE PREFERRED EMBODIMENT

Figure 1:
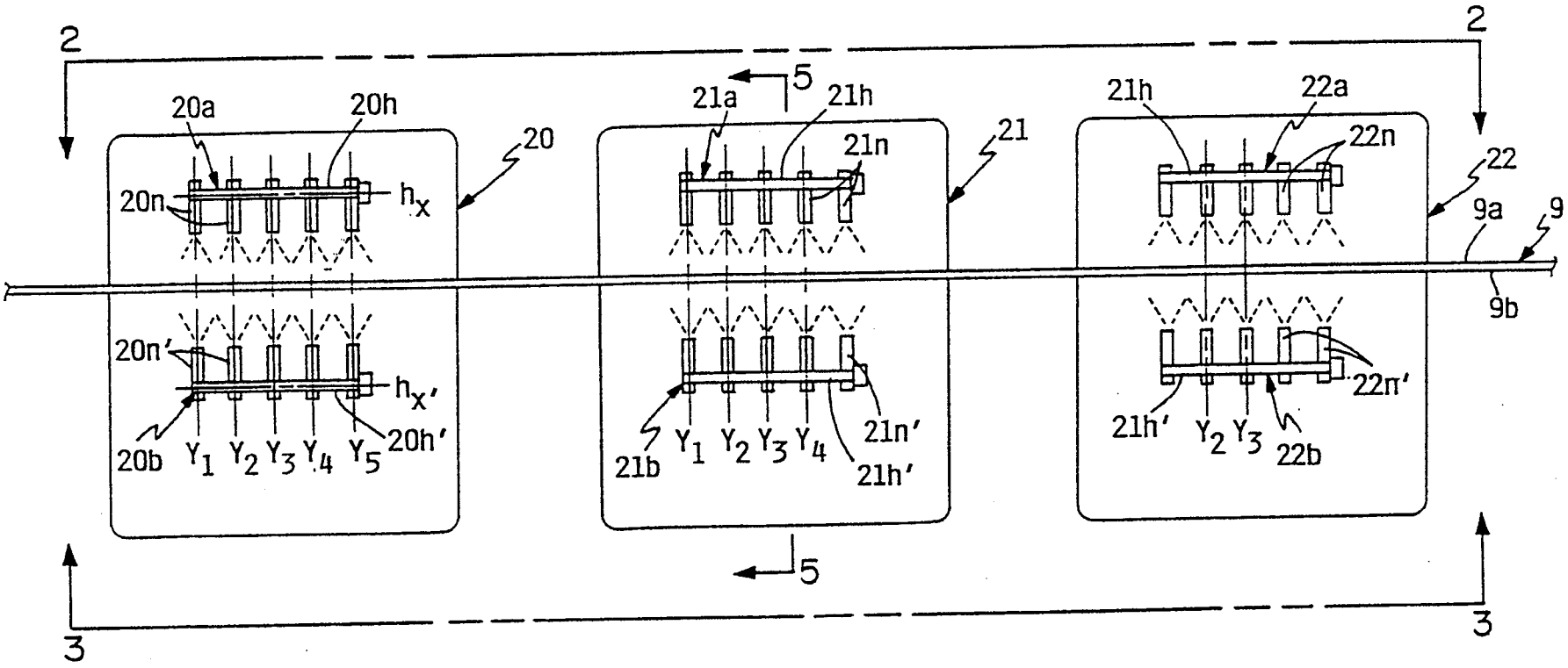
FIG. 1 is a partial schematic view of upper and lower etching chambers located proximate a moving web.

FIG. 1 shows a partial schematic side view of etching stations 20, 21 and 22, with a metal web 9 extending horizontally therethrough. As web 9 passes through the etching stations, each of the nozzles sprays etchant onto the metal web. Etching station 20 includes an upper etching chamber **20*a* and a lower etching chamber 20*b*. Etching chamber 20*a* includes upper header 20*h* with a plurality of nozzles 20*n* which are oscillatable about header axis $h_x$. Similarly, etching chamber 20b located on the underside of web 9 includes header 20h' which have nozzles 20n' which are oscillatable about header axis $h'_x$ through header 20h'. To illustrate the vertical spacing and alignment of the nozzles, FIG. 1 shows planes y1, y2, y3, y4 and y5 drawn through lower nozzles 20n' and upper nozzles 20n which are located in etching chamber 20. Similarly, etching chambers 21 and 22** have the same vertical spacing and vertical alignment of etching nozzles located therein.

Figure 2:
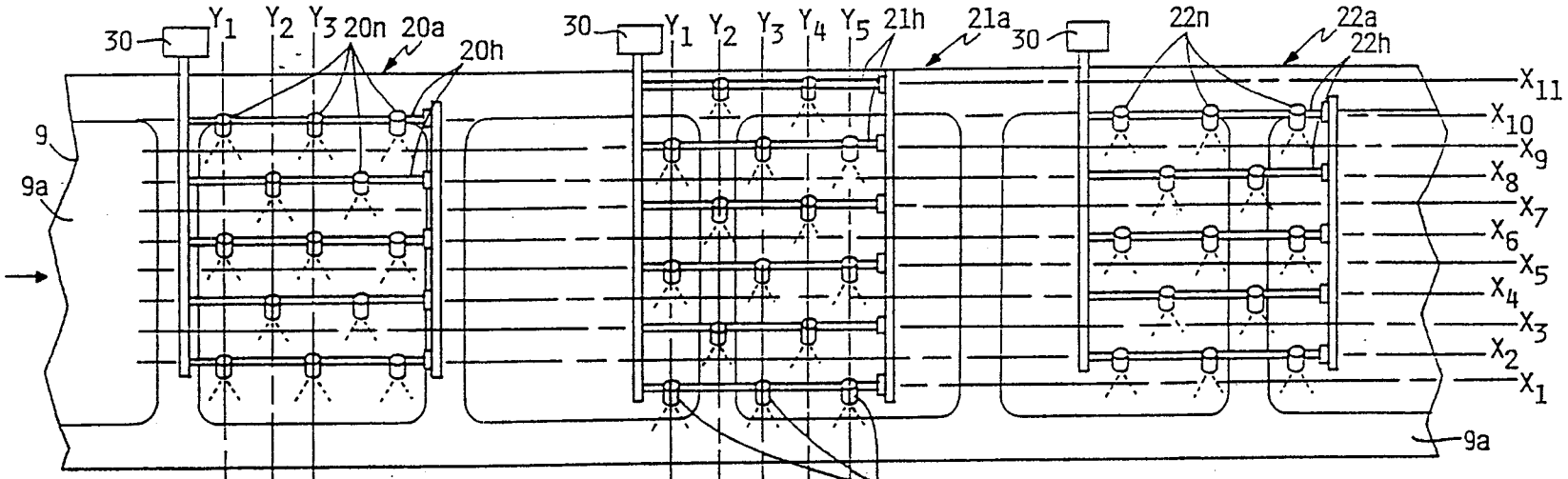
FIG. 2 is a view taken along lines 2—2 of FIG. 1.
Figure 3:
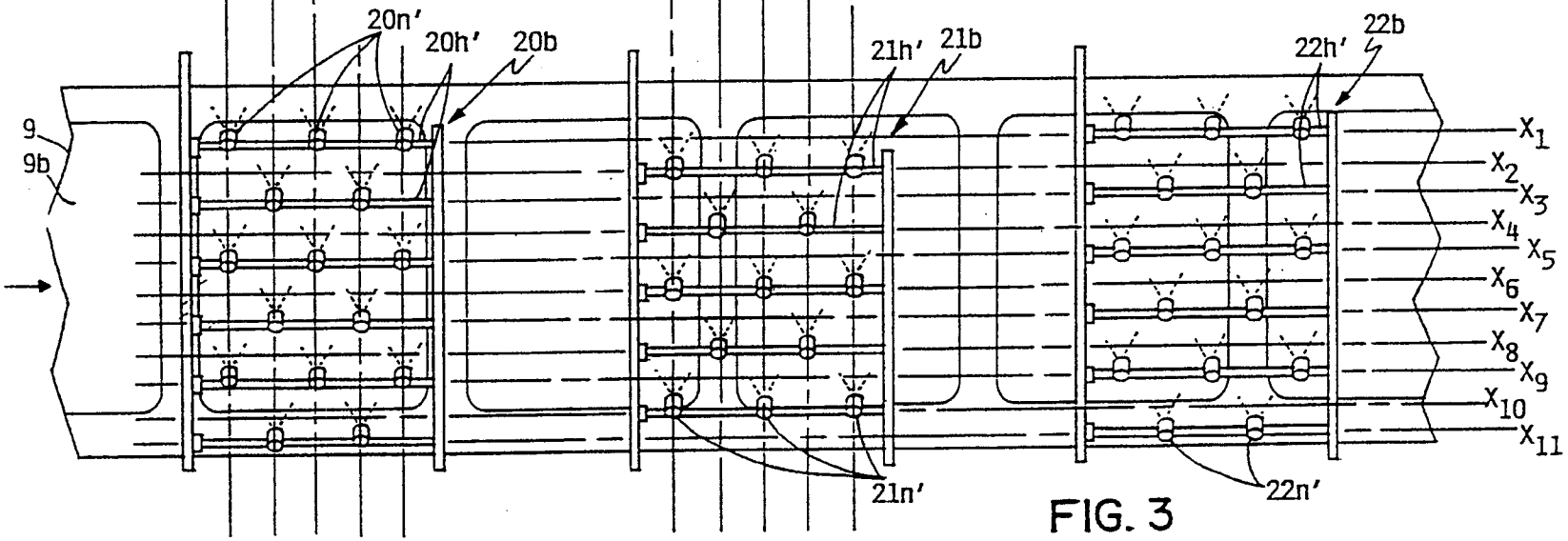
FIG. 3 is a view taken along lines 3—3 of FIG. 1.

FIGS. 2 and 3 illustrate in partial schematic the location and arrangement of the oscillating nozzles in each etching chamber. The bank of upper nozzle and the bank of lower nozzles are laterally offset from one another with the bank of nozzles in adjacent chambers also offset from adjacent banks of nozzles. Reference numeral 20n identifies the first set of upper oscillatable nozzles in chamber 20. The oscillatable nozzles 20n are located on five headers 20h which are located in a spaced and parallel relationship to one another. Located on each of headers 20h are oscillatable nozzles 20n which direct etchant onto the top of web 9. A driving mechanism 30 oscillates headers 20h and nozzles 20n to spray etchant laterally across the top surface 9a of web 9.

Etching chamber 21a includes a second set of identical oscillatable upper nozzles 21n. In addition, etching chamber 21 includes an extra row of nozzles. Similarly, etching chamber 22a includes a third set of identical, oscillatable upper nozzles 22n. Oscillatable nozzles 20n and 22n are identical in their position and oscillation with respect to web 9, while oscillatable nozzles 2 in are offset from the nozzles 20n and 22n. To illustrate the offset relationship of the upper nozzles, a series of parallelly spaced reference planes $x_1$ through $x_{11}$ extend vertically through stations 20, 21 and 22. To illustrate the offset relationship of the upper nozzles with respect to the lower nozzles, reference should be made to FIG. 4 which shows the upper nozzles 20n in solid and the lower nozzles 20n' in phantom.

Figure 4:
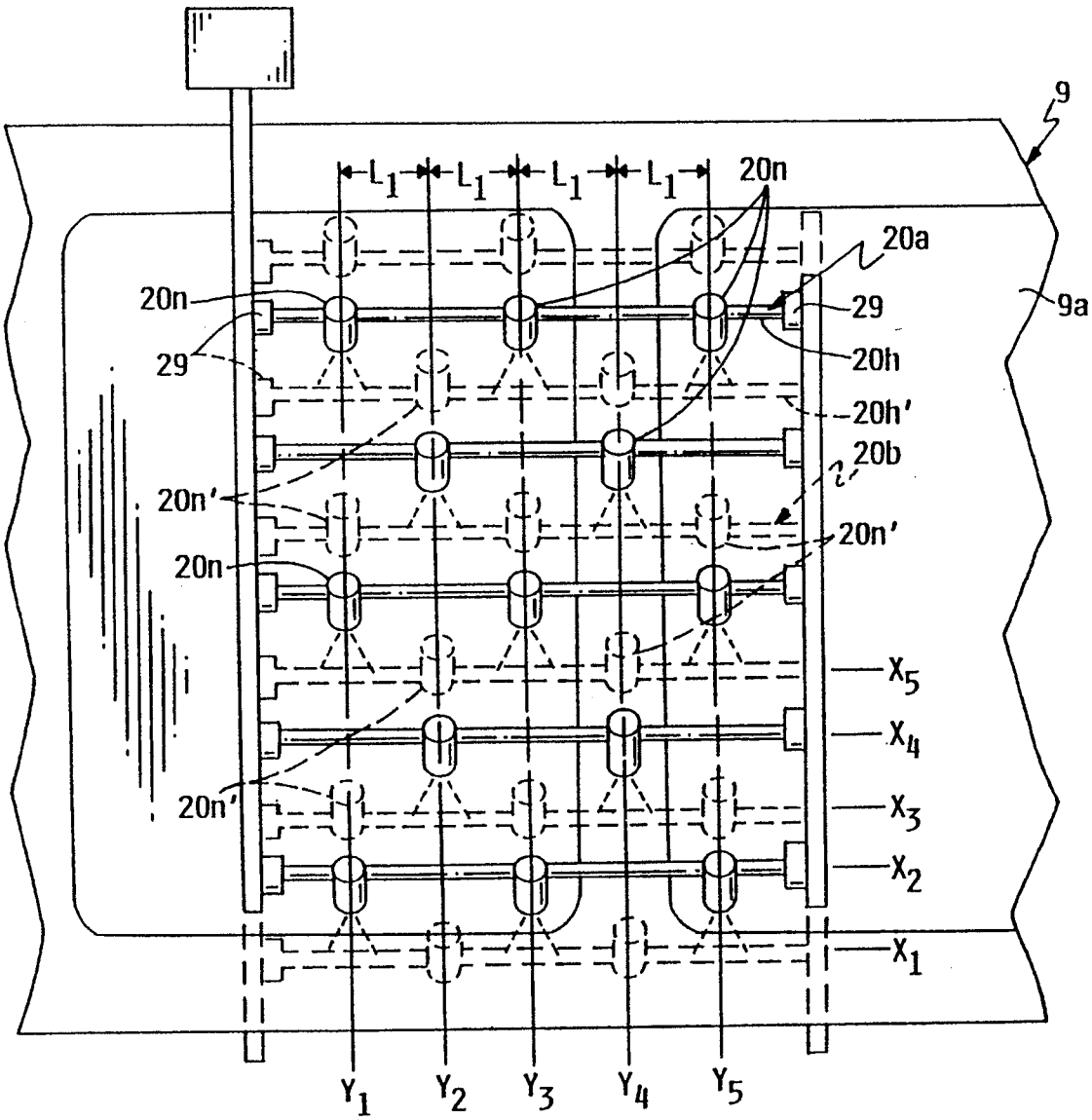
FIG. 4 shows a partial sectional view of an etching station upper spray nozzles and lower spray nozzles with the lower spray nozzles located in phantom.

FIG. 4 illustrates the lateral offset of the upper and lower banks of the oscillating nozzles which occurs in a single etching station. The bank of upper nozzles 20n located above web 9 is shown in solid lines, and a bank of lower oscillating nozzles 20n' is shown in dashed lines. Attention is called to the fact that each of the nozzles is located in equally spaced planes $y_1$ through $y_5$, which are perpendicular to web 9 and extend vertically downward from the top oscillating nozzles 20n through the lower oscillating nozzles 20n'.

FIG. 4 illustrates the lateral offset of upper nozzles 20n from the lower nozzles 20n'. The upper nozzles 20n are located in even planes $x_2$, $x_4$, etc., while the lower nozzles 20n' are located in odd planes, $x_1$, $x_3$, $x_5$, etc. From the drawing, it can be seen that lower nozzles 20n' are spaced midway between the upper nozzles 20n and staggered thereout, so they do direct etchant on the opposed portions on the top and bottom of web 9. Thus, FIG. 4 illustrates that the grid pattern formed by the nozzles in the upper chamber and lower chamber of the same etching station are substantially identical except they are offset from one another so they do not spray etchant onto opposed regions on the opposite sides of web 9.

To illustrate the offsetting of nozzles in each etching station with respect to adjacent etching stations, reference should be made to FIGS. 2 and 3. FIGS. 2 and 3 are laid out so that the upper and lower views of etching chambers 20, 21 and 22 are in alignment with one another. To illustrate the offset of nozzles 20n, 21n and 22n in upper etching chambers 20, 21 and 22, reference planes have been dram perpendicular to web 9 and are identified by $x_1$ through $x_{11}$. The position of planes $x_1$ through $x_{11}$ is also shown in FIG. 3 to show the position of the lower bank of nozzles 20n', 21n' and 22n' with respect to the same reference planes.

FIG. 2 shows that the upper nozzles 20n and 22n are located in even reference planes $x_2$, $x_4$, $x_6$, $x_8$ and $x_{10}$, while the central station oscillating nozzles 21 oscillate about the odd planes which extend along planes $x_1$, $x_3$, $x_5$, $x_7$, $x_9$ and $x_{11}$. Thus, it is apparent that the nozzles in the top chambers of adjacent etching stations are offset from one another. Similarly, the nozzles in each of the bottom etching stations are also offset from one another. That is, the lower bank of nozzles 21n' oscillate about even planes $x_2$, $x_4$, $x_6$, $x_8$and $x_{10}$, while nozzle 20n' in station 20b and nozzles 22n' in station 22b oscillate about the odd planes $x_1$, $x_3$, $x_5$, $x_7$, $x_9$ and $x_{11}$. Thus, is can be seen that not only the top and bottom banks of nozzles are offset from one another, but both the top and bottom banks of nozzles in adjacent etching stations are offset from one another, thus providing a double offset so that no one region of the web receives a same or similar spray etching from an adjacent etching station.

Figure 5:
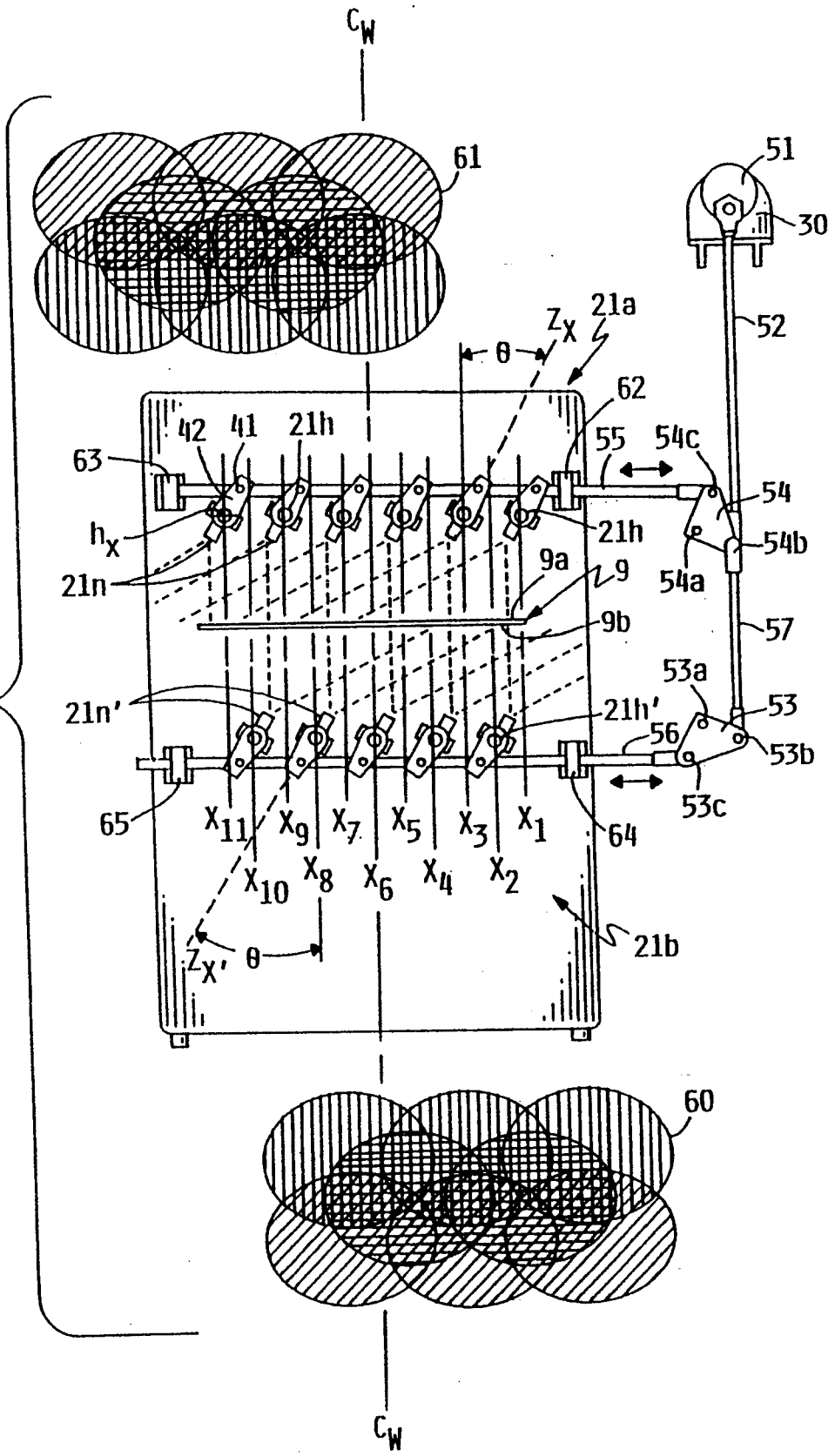
FIG. 5 shows a partial sectional view of the oscillating system and a partial spray pattern as a result of the oscillation by a mechanical drive.

FIG. 5 shows a partial schematic taken along lines 5—5 of FIG. 1. FIG. 5 illustrates a mechanism for oscillating the upper and lower banks of nozzles as well as a partial nozzle spray pattern 61 on the upper side 9a of web 9 and a partial nozzle spray pattern 60 on the lower side 9b of web 9.

FIG. 5 shows that the axis of oscillations of the nozzles are offset a predetermined angle from a vertical axis to provide an elliptical spray pattern on both the top and bottom of the mask.

To illustrate the relationship of the oscillating nozzles of the upper and lower chamber in a single etching station, reference should be made to FIG. 5. Since each of the oscillating nozzles is identical in the upper and lower chamber, only one nozzles will be described with respect to its oscillation about an axis $h_x$ extending through its header.

Reference numeral 21n identifies an oscillating nozzle having a pivot pin 41 and an arm 42. Oscillating nozzle 21n is located on header 21h and oscillates about header axis $h_x$. When the oscillating nozzles 21n are operating, a motor 30 drives a crank 51 which connects to arms 52 and 57. Arm 52 connects to upper pivotal plate 54 and lower pivotal plate 53. Upper pivotal plate 54 pivots about pivot pin 54a, and, similarly, lower pivot plate 53 pivots about pivot pin 53a. The back-and-forth movement of arm 52 moves arm 57 which is pivotally connected to plate 54 by pivot pin 54b and to plate 53 by pivot pin 53b. Since pivot pins 53a and 54a are fixed, pivot plate 54 forces member 55 to oscillate back and forth in a direction indicated by the arrows. Similarly, pivot plate 53 forces member 56 to oscillate back and forth in the direction indicated by arrows. As a result of the driving action of motor 30, the upper nozzles 21n which are connected to member 55 oscillate about a non-vertical axis $z_x$. Similarly, the lower nozzles oscillate about a lower non-vertical axis $z'_x$., which is parallel to axis $z_x$. As the upper and lower nozzles oscillate, they spray etchant onto web 9. The upper overlapping spray pattern of three adjacent rows of nozzles is indicated by reference numeral 61, and comprises a plurality of elliptically shaped regions. Similarly, the lower overlapping spray pattern of three adjacent rows of nozzles is indicated by reference numeral 60 on the underside of web 9 and also comprises a plurality of elliptical shaped regions which, as shown in the drawing, are biased to the fight, while the spray pattern on top is biased to the left. While the spray pattern in adjacent stations is substantially identical, the spray pattern in adjacent stations is offset since the nozzles in adjacent stations are offset from one another.

The elliptically shaped regions 60 and 61 result from the axis $z_x$ of each of the nozzles being offset at an angle of approximately 33 degrees from a line extending perpendicularly to web surface 9. Reference letter theta on the drawing indicates the offset angle. In the preferred embodiment, the nozzles are spaced about five to 12 inches from the metal web and oscillate within the frequency range of 30 to 60 cycles per minute and have a maximum oscillation angle about axis $z_{x'}$ or axis $z_x$ which ranges from approximately 10 degrees to 30 degrees on each side of the axis $z_{x'}$ or axis $z_x$.

Figure 6:
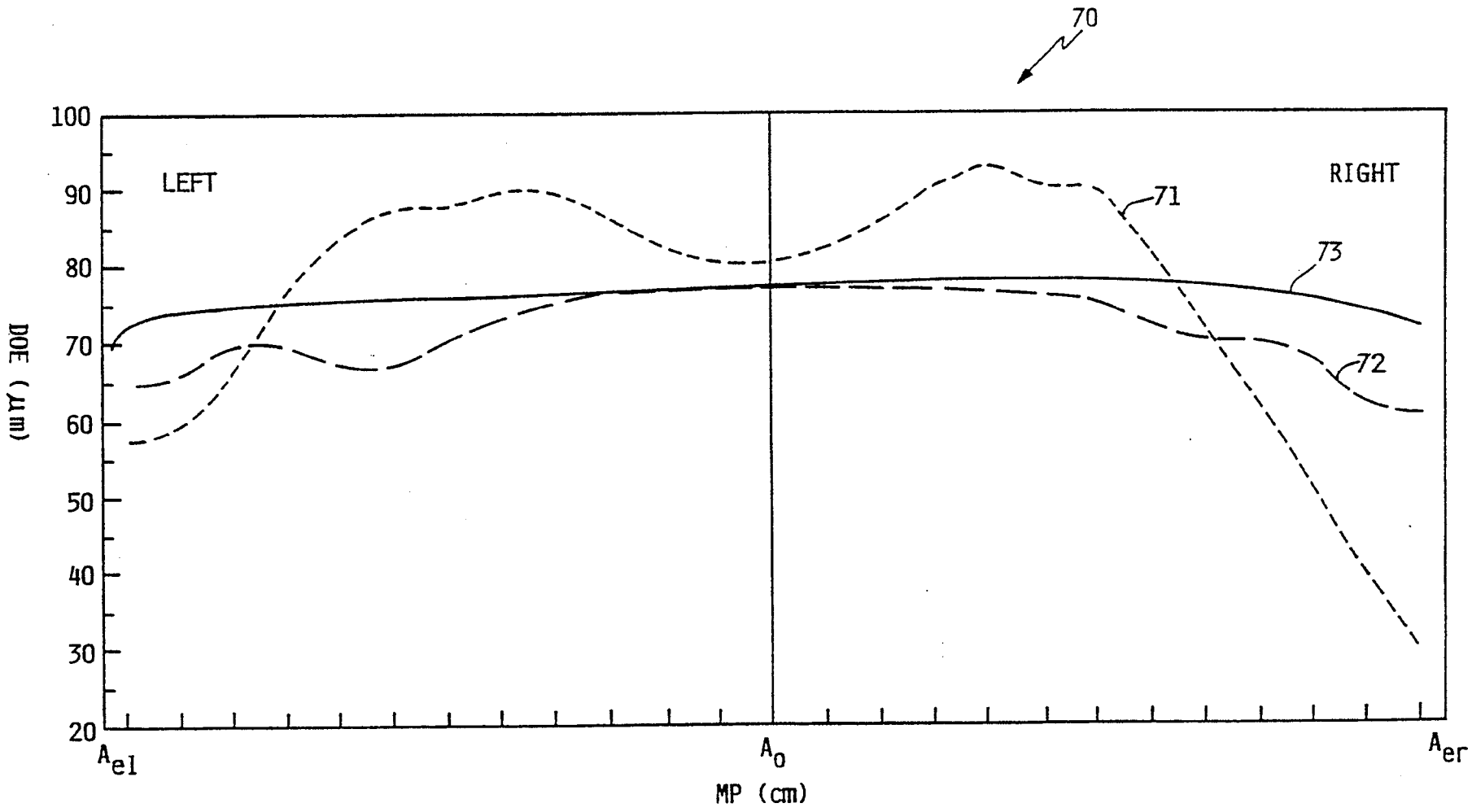
FIG. 6 is a graph representing the depth of etch as a function of the mask position for various types of etchant distribution systems.

To illustrate the depth of etch on a metal web under different oscillating spray conditions, reference should be made to FIG. 6. The vertical axis identifies the depth of etch, while the horizontal axis identifies the lateral position across a shadow mask. The reference $A_o$ indicates the center of the mask, $A_{el}$ indicates the left edge of the mask, and $A_{er}$ indicates the fight edge of the mask.

Graph 71 identifies the variation of depth of etch when stationary nozzles are used. Note that the depth of etch varies considerably from one side of the mask to the other side. Under these conditions, breakthrough would occur throughout the mask at different times.

Graph 72 identifies the variation of depth of etch from one side of the mask to the other side of the mask in prior-art systems. Note that the depth of etch, although varying considerably from one side to the other, is more uniform than if stationary nozzles were used.

Graph 73 identifies the variation of depth of etch from one side of the mask to the other side with the etchant distribution system utilizing oscillating nozzle system of FIG. 5. Note that the depth of etch remains substantially constant from one side to the other side of the mask. The result is that, when etching a metal web from opposite sides, the goal of obtaining a breakthrough at virtually identical times will be substantially achieved. With breakthrough occurring in the mask at virtually the same time, one is assured that, although different etching rates exist prior to and after breakthrough, the etching at varying regions across the mask will be substantially the same so that the final dimensions of the aperture can be more accurately controlled.

Figure 7:
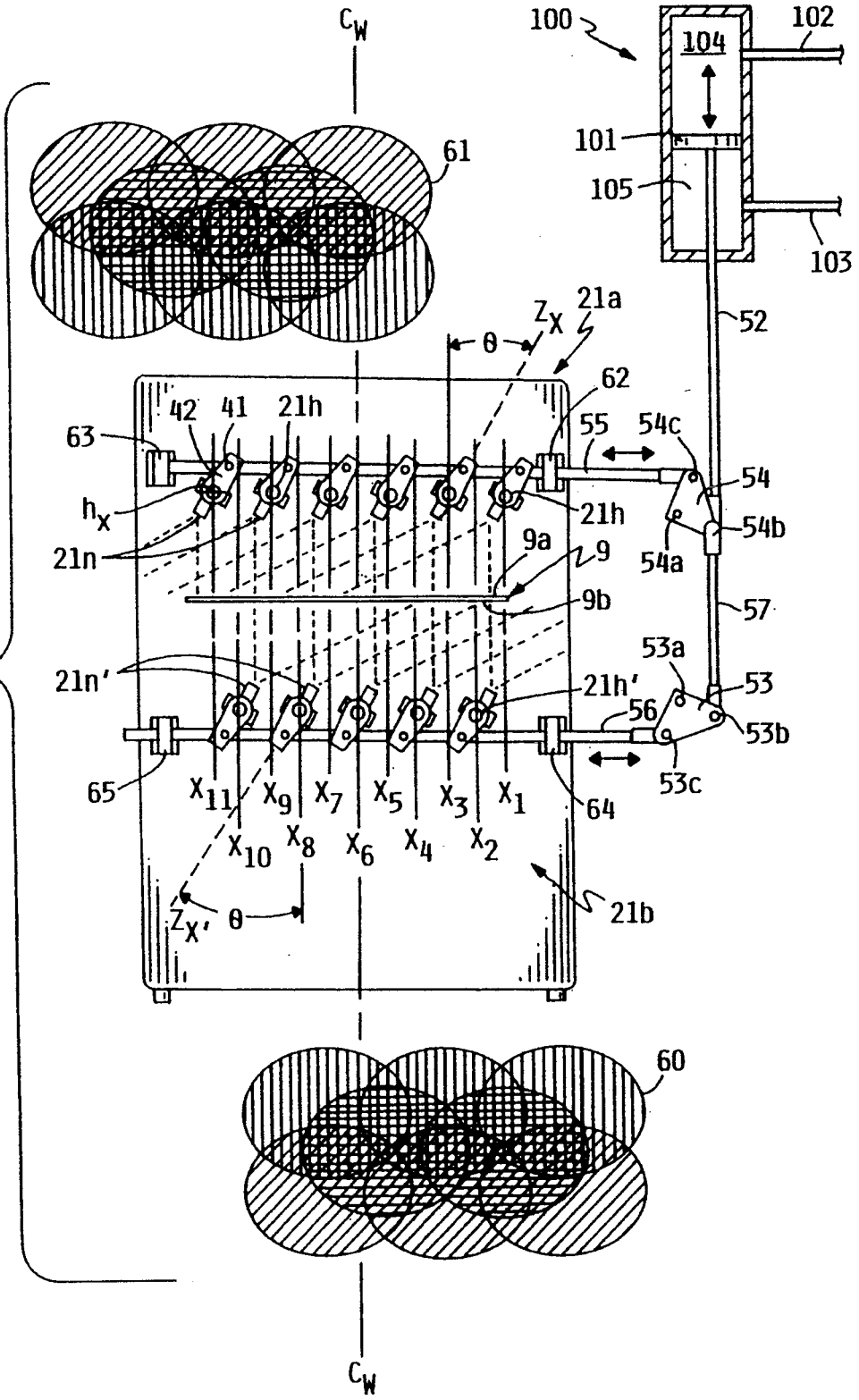
FIG. 7 shows a partial sectional view of the oscillating system of FIG. 5 powered by a single pressure-activateable cylinder.

FIG. 5 shows the nozzles being oscillated by a mechanical oscillator driven by a rotating crank. FIG. 7 shows the identical etching system being driven by a hydraulic cylinder 100. The hydraulic cylinder has a slidable piston 101 located therein. Located on one end of cylinder 1130 is a first chamber 104 connected to a hydraulic line 102 for directing hydraulic fluid into or out of chamber 104. Similarly, located on the opposite end of cylinder 100 is a second chamber 105 connected to a hydraulic line 103 for directing hydraulic fluid into or out of chamber 105.

Figure 10:
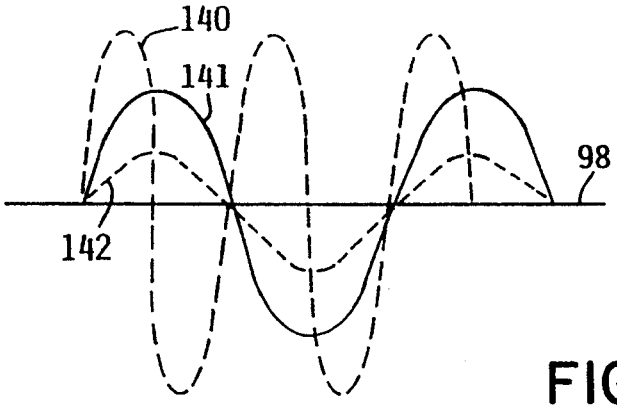
FIG. 10 shows the sinusoidal waveform of the oscillating system powered by a mechanical drive.

Referring to FIG. 10, reference numeral 98 identifies a reference axis and reference numerals 140, 14 1 and 142 identify the sinusoidal motion of the tips of the nozzles as they are driven by the mechanical oscillator shown in FIG. 6. That is, a rotating crank drives the nozzles in a sinusoidal waveform. As part of the adjustment for the etching stations, the nozzle frequency can be increased as indicated by curve 140 or the frequency can be kept the same, as indicated by curve 141 and cure 142, while the amplitude is decrease& However, in each case, the change to the mechanically rotating crank stroke provides a sinusoidal waveform to the tips of the nozzle. In some cases, the amplitude of the sinusoidal wave may be greater or lesser, and, in other cases, the frequency may be increased or decreased, but in all cases, the crank rotating at a constant speed produces a sinusoidal waveform. It should be pointed out that reference to the waveform of the nozzles is the time path followed by the nozzles as they oscillates from side to side within the etching chamber. It is also the time movement of the piston in the hydraulic cylinder in response to control signals from a wave generator.

Figure 11:
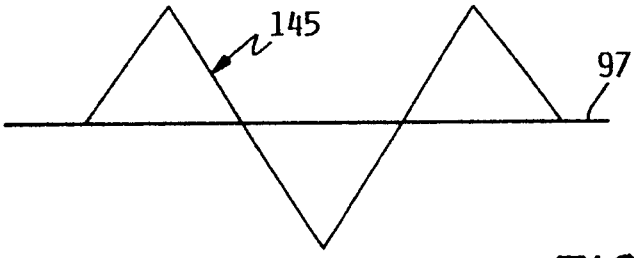
FIG. 11 shows an alternate waveform of the oscillating system powered by the pressure-controllable two-way hydraulic cylinders of FIG. 7.

Referring to FIG. 11, reference numeral 97 identifies a reference axis and reference numeral 145 shows one of a number of possible waveforms that hydraulic cylinder 100 may follow. That is, 145 denotes a saw-tooth waveform as opposed to the sinusoidal waveform shown in FIG. 10.

Figure 12:
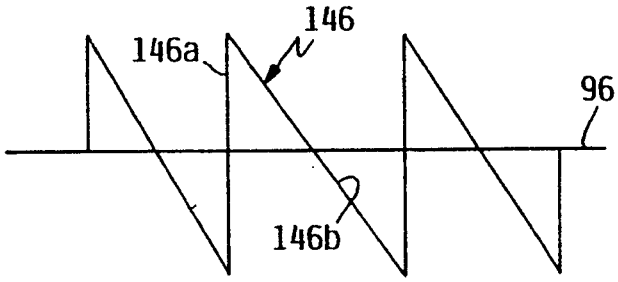
FIG. 12 shows a further alternate waveform of the oscillating system powered by the pressure-controllable, two-way hydraulic cylinders of FIG. 7.

Similarly, in FIG. 12, reference numeral 96 identifies a reference axis and reference number 146 identifies another non-sinusoidal waveform with an abrupt return **146*a* followed by a gradually sweeping motion as indicated by 146*b***.

Figure 8:
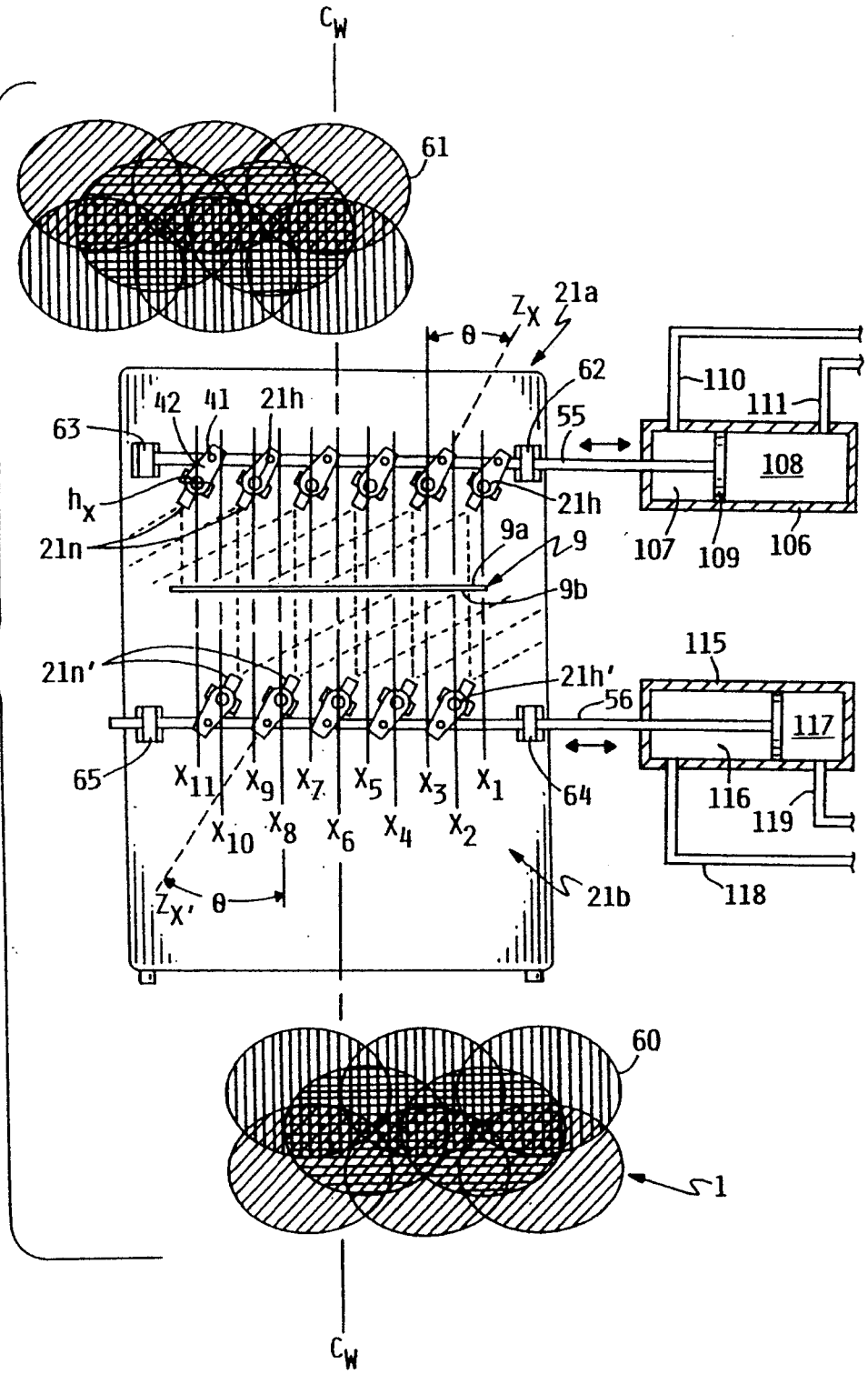
FIG. 8 shows a partial sectional view of the oscillating system of FIG. 5 powered by two pressure activateable cylinders.
Figure 13:
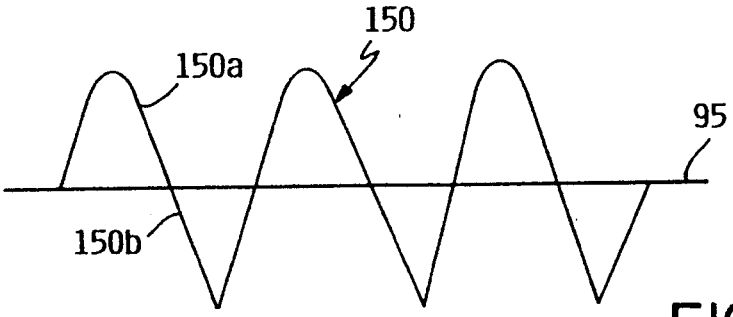
FIG. 13 shows a further alternate complex waveform of the oscillating system powered by the pressure-controllable, two-way hydraulic cylinders of FIG. 8.

FIG. 13 further illustrates a complex waveform obtainable with the hydraulic cylinder system shown in FIG. 7 or FIG. 8. That is, the shape of the first portion of the waveform **150*a* located above the axis 95 may be sinusoidal and the lower portion of the waveform 150*b* may be saw-tooth. By measuring the effects of waveform on etchant rate, one can obtain reference information correlating the etchant rate to a particular waveform of the etchant nozzles. Thus, the path of the oscillation of the nozzles tips and, consequently, the etchant projectory in which the etchant is sprayed is not limited in accordance with the sinusoidal waveform. Furthermore, by use of two independent hydraulic cylinders as shown in FIG. 8**, the path of oscillation of the nozzles in the upper chamber can be oscillated independent of the path of oscillation of the nozzles in the lower chamber. While hydraulic cylinders are shown as the means to change the waveform of the nozzles, other drive means that can change the waveform while on-the-go could also be used.

FIGS. 11–13 illustrate the difference between changing the waveform, and FIG. 100 illustrates what is meant by changing the wave shape such as altering the frequency or amplitude of the wave.

Figure 9:
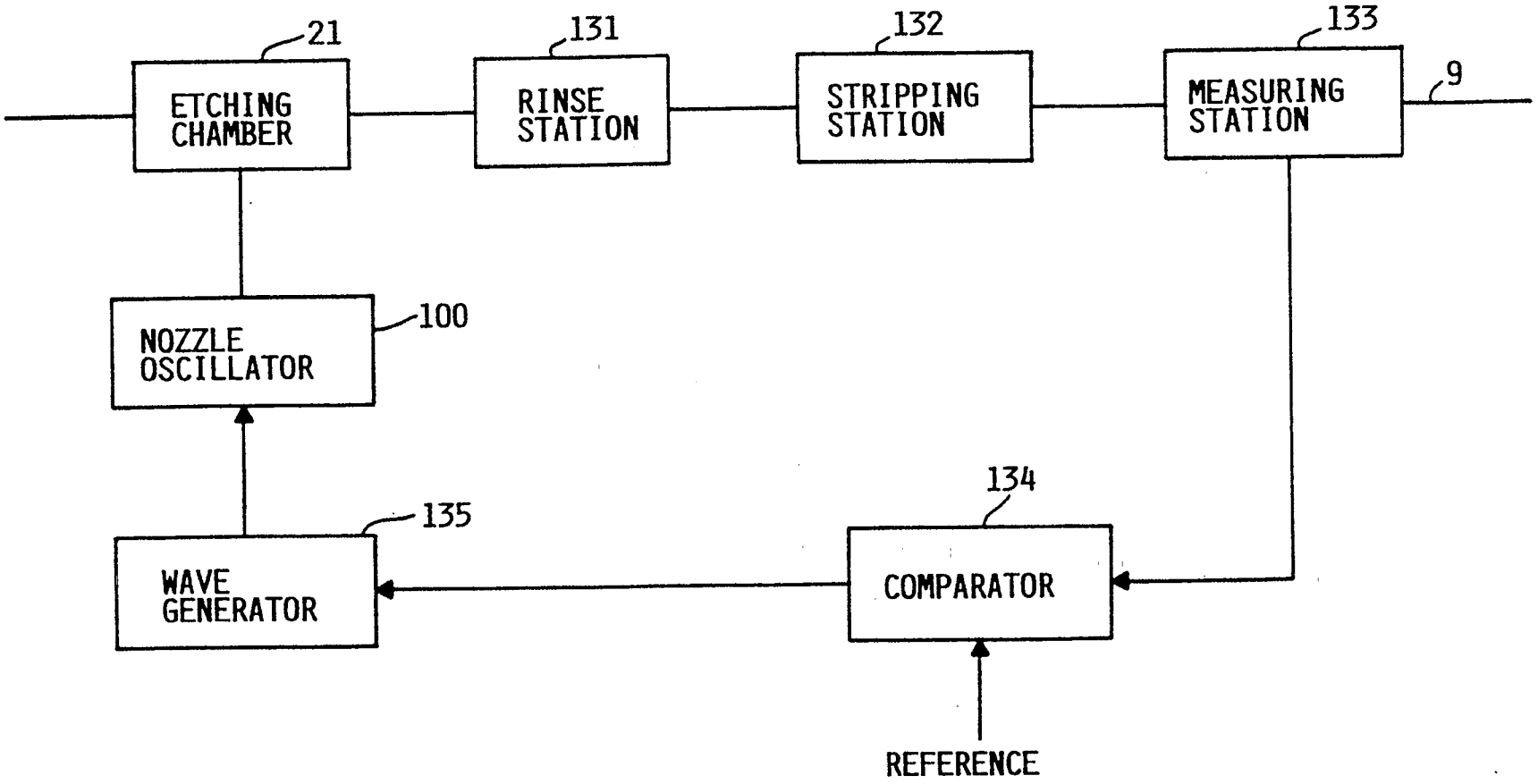
FIG. 9 shows block diagram of a system for measuring, comparing and effecting etching rate changes by changing the waveform of the oscillating nozzle.

FIG. 9 shows a block diagram of portion of an aperture mask etching system for controlling the etching rate without having to change the pressure of flow ram of the etchant by feeding back information from etched masks to masks where etching has not yet been completed. Reference numeral 9 identifies the moving web, reference numeral 21 identifies etching chambers; reference numeral 131 identifies an inline etchant rinse station and reference numeral 132 identifies an inline etchant-resist stripping station.

Located after the sapping station 132 is an inline measuring station 133 which typically includes a densitometer or some other type of measuring device to measure the size or shape of the openings in the aperture mask. One such device is more fully shown and described in U.S. Pat. No. 3,645,811. The measurements of the hole size or shape are converted to an electrical signal which is sent to a signal comparator 134 where it is compared to a reference signal. Based on the differences between the reference signal and the signal from measuring station, a corrective signal, if any is necessary, is sent to the wave generator 135, which generates the appropriate waveform to drive the nozzle oscillator 100–101 in accordance with the required correction. That is, the spray pattern on the metal web is changed by solely changing the waveform of the nozzles. Consequently, more or less etchant can be delivered to different portions of the mask and the corrections to the etching chamber can be done on-the-go and automatically without the necessity of resetting pressures in the system or mechanically adjusting the amplitude of the oscillation.

While the system is described in relation to staggered and offset nozzles, the control system is also suitable for other oscillating nozzle systems. While changes in etching pasterns can be obtained by changing the angle of oscillation of the nozzles as well as the axis of oscillation, the use of changing waveform allows changes to the etching rate without having to manually adjust the system. Although the present invention is described with respect to staggered and offset oscillating nozzles, the system can be used with other arrangements of oscillating nozzles.

I claim:

1. The method of spray etching on a metal web comprising:

establishing a first grid pattern of oscillatable nozzles for etching the metal web from a first side of a metal web in accordance with a first waveform;

establishing a second grid pattern of oscillatable nozzles for etching the metal web from the first side of the metal web in accordance with a second waveform, said second grid pattern offset from said first grid pattern;

establishing a third grid pattern of oscillatable nozzles for etching the metal from the first side of the metal web in accordance with a third waveform with said third grid pattern offset from said second grid pattern;

etching the metal web to form openings in the metal web by spraying etchant through said nozzles while oscillating at least some of said nozzles in accordance with the first waveform;

measuring the size of the openings formed in,the metal web to obtain measurements of the opening; and oscillating the nozzles in accordance with a different waveform in response to the measurements to change the etchant flow distribution on the metal web without changing the etchant flow rate to the oscillating nozzles to compensate for changes in etching conditions or metal web thickness.

2. The method of claim 1 including:

establishing a fourth grid pattern of oscillating nozzles for etching the metal web from the opposite side of the metal web, said fourth grid pattern of oscillatable nozzles offset from said first grid pattern of oscillating nozzles;

establishing a fifth grid pattern of oscillating nozzles for etching the metal web from the opposite side of the metal web, said fifth grid pattern offset from the fourth grid pattern of oscillating nozzles;

establishing a sixth grid pattern of oscillatable nozzles for etching the metal web from the opposite side of the metal web; said sixth grid pattern offset from said fifth grid pattern of oscillating nozzles; and simultaneously oscillating all the nozzles while spraying etchant from the oscillatable nozzles onto both sides of the metal web and the opposite side of the metal web so that the cumulative amount of etchant sprayed on the metal web is uniformly distributed over both surfaces of the metal web.

3. The method of claim 1 including the step of oscillating each of the nozzles over an angle of approximately 60 degrees with the axis of the center of oscillation located at an angle of approximately 33 degrees to an axis perpendicular to the surface of the metal web.

4. A method to be employed in conjunction with an etching station comprising:

(a) at lease one set of etchant nozzles;

(b) at least one source of etchant for directing an etchant through the etchant nozzles and onto a metal web;

(c) means for oscillating the etchant nozzles in accordance with a first waveform as the etchant is sprayed therethrough;

the method comprising the steps of:

(1) measuring an etched hole in the metal web to obtain measurements of the hole;

(2) comparing the measurements of the etched hole in the metal web to a reference to determine adjustments, if any, to be made to the waveform; and (3) changing the waveform of the means for oscillating the etchant nozzles in response to the measurements of the hole to thereby change the pattern of etchant sprayed onto the metal web to effect changes in a size of a further hole etched in the metal web.

5. The method of claim 4 wherein the changes in the waveform are made on-the-go.

6. An etching system for etching openings in a metal web comprising:

an etching station for etching a metal web from opposite sides comprising:

a first bank of oscillatable nozzles located in a first chamber in said etching station, said first bank of oscillatable nozzles having predetermined spacings from one another, said first bank of oscillatable nozzles oscillatable in accordance with a first waveform and for directing etchant on a first region on a first side of a metal web;

a second bank of oscillatable nozzles located in a second chamber in said etching station and oscillatable in accordance with a second, saveform, said second bank of oscillatable nozzles having a predetermined spacing substantially identical to said first bank of oscillatable nozzles with said second set of oscillatable nozzles laterally offset from said first set of nozzles, so as not to spray on a second region located on a second side of the metal web which is located directly opposite of said first region; and means to oscillate said nozzles in accordance with different waveforms in response to measurements of etched openings in the metal web to on-the-go compensate for changing etching conditions or changes in the thickness of the metal web.

7. The etching system of claim 6 including a second etching station, said second etching station located proximate said first etching station, said second etching station including a third bank of oscillatable nozzles located in a first chamber in said second etching station, said third bank of oscillatable nozzles having a predetermined spacing from each other, said third bank of oscillatable nozzles substantially identical to said first bank of nozzles and said second bank of oscillatable nozzles, said third bank of oscillatable nozzles located in offset relationship to said first bank of oscillatable nozzles but not with respect to said second bank of oscillatable nozzles.

8. The etching system of claim 7 including a fourth bank of oscillatable nozzles located in a second chamber in said second etching station, said fourth bank of oscillatable nozzles having a predetermined spacing substantially identical to said first bank of oscillatable nozzles with said fourth set of oscillatable nozzles laterally offset from said second bank of oscillatable nozzles and said third bank of oscillatable nozzles but not with respect to said first bank of oscillatable nozzles.

9. The etching system of claim 6 wherein one bank of nozzles in the etching station includes an even number of headers and said other bank of nozzles includes an odd number of headers.

10. The etching system of claim 6 wherein said first bank of nozzles is offset halfway between said second bank of nozzles.

11. The etching system of claim 8 wherein said fast bank of nozzles and said second bank of nozzles have an axis of oscillation of approximately 33 degrees from a normal to the surface of the metal web.

12. An etching apparatus for etching a metal web by spraying etchant through oscillating nozzles oscillated in a first waveform with said oscillating nozzles located proximate the metal web with the improvement comprising means for changing the waveform of the oscillating nozzles without changing the etchant flow rate through the nozzles to alter the distribution of etchant sprayed onto the metal web to compensate for changes in etching conditions or thickness of the metal web.

13. The etching apparatus of claim 12 wherein the means for changing the waveform includes a pressure-activatable hydraulic cylinder.

14. The etching apparatus of claim 12 wherein the means for changing the waveform includes at least two pressure-activatable hydraulic cylinders for changing the waveform of at least some nozzles independently of other nozzles.

15. An etching station for etching a metal web from opposite sides comprising:

a first bank of oscillatable nozzles located in a first etching chamber on one side of a metal web, each of said nozzles having an axis of oscillation, said axis of oscillation located at an angle of approximately 33 degrees from a plane extending substantially perpendicular to one side of a metal web, each of said nozzles oscillating about a maximum cone angle of approximately 60 degrees in accordance with a first waveform to provide an elliptically shaped etchant spray pattern on the metal web: and means to oscillate said nozzles in accordance with a waveform different from said first waveform in response to a measurement of the metal web to compensate for changing etching conditions or changes in the thickness of the metal web.

* * * * *

UNITED STATES PATENT AND TRADEMARK OFFICE

CERTIFICATE OF CORRECTION

PATENT NO. : 5,387,313

DATED : February 7, 1995

INVENTOR(S) : ROLAND THOMS

It is certified that error appears in the above-indentified patent and that said Letters Patent is hereby corrected as shown below:

Col. 3, line 11, delete "change", insert --changing--

Col. 3, line 26, delete "carded", insert --carried--

Col. 3, line 36, delete "mash", insert --masks--

Col. 3, line 52, delete "delver", insert --deliver--

Col. 3, line 58, delete "a etching", insert --an etching--

Col. 5, line 32, delete "2 in", insert --21n

Col. 6, line 4, delete "dram", insert --drawn--

Col. 6, line 20, delete "Thus, is", insert --Thus, it--

Col. 6, line 42, delete "nozzles", insert --nozzle--

Col. 7, line 6, delete "fight", insert --right--

Col. 7, line 28, delete "fight", insert --right--

Col. 7, line 58, delete "1130", insert --100--

Col. 7, line 65, delete "14 1", insert --141--

UNITED STATES PATENT AND TRADEMARK OFFICE

CERTIFICATE OF CORRECTION

PATENT NO. : 5,387,313

DATED : February 7, 1995

INVENTOR(S) : ROLAND THOMS

It is certified that error appears in the above-indentified patent and that said Letters Patent is hereby corrected as shown below:

Col. 8, line 4, delete "cure", insert --curve--

Col. 8, line 5, delete "decrease&", insert --decreased--

Col. 8, line 14, delete "oscillates", insert --oscillate--

Col. 8, line 55, delete "ram", insert --rate--

Col. 8, line 63, delete "sapping", insert --stripping--

Col. 9, line 19, delete "pasterns", insert --patterns--

Col. 9, line 47, delete "in, the", insert --in the--

Col. 10, line 16, delete "lease", insert --least--

Col. 10, line 50, delete "second, saveform", insert --second waveform--

Col. 11, line 24, delete "fast", insert --first--

Signed and Sealed this

Fourth Day of July, 1995

*Attest:*

Bruce Lehman

BRUCE LEHMAN

*Attesting Officer*

*Commissioner of Patents and Trademarks*